United States Patent [19]

Lanfermann et al.

[11] 3,968,754

[45] July 13, 1976

[54] CHAIN DRIVE ARRANGEMENT FOR A MINING MACHINE

[75] Inventors: Willy Lanfermann; Paul Kaisler; Dieter Lauterbach, all of Bochum, Germany

[73] Assignee: Gebr. Eickhoff, Maschinenfabrik und Eisengiesserei m.b.H., Bochum, Germany

[22] Filed: Jan. 13, 1975

[21] Appl. No.: 540,556

[30] Foreign Application Priority Data

Jan. 11, 1974 Germany.....24011981

[52] U.S. Cl...... 104/172 R; 104/196

[51] Int. Cl.[2]..... B61B 13/00

[58] Field of Search..... 104/147 R, 165, 169, 104/117, 172 R, 172 B, 172 C, 178, 196, 198, 199, 202, 209, 211, 212, 222, 224, 235, 236; 105/161; 299/34, 43; 24/116 R, 132 AT, 132 WL, 248 R, 248 E, 248 CR, 248 SB

[56] References Cited

UNITED STATES PATENTS

| | | | |
|---|---|---|---|
| 364,489 | 6/1887 | Dale | 104/196 |
| 411,762 | 9/1889 | Davies | 104/235 X |
| 655,681 | 8/1900 | Beamer | 104/235 X |
| 2,684,040 | 7/1954 | Talboys | 104/235 |
| 3,012,520 | 12/1961 | Curtis | 104/178 X |
| 3,337,269 | 8/1967 | Mennekes et al. | 299/34 |
| 3,370,549 | 2/1968 | Livingston | 104/212 |
| 3,892,184 | 7/1975 | Kenn et al. | 104/147 R |

FOREIGN PATENTS OR APPLICATIONS

| | | | |
|---|---|---|---|
| 1,215,207 | 12/1970 | United Kingdom | 299/34 |

*Primary Examiner*—Frank E. Werner
*Assistant Examiner*—Randolph A. Reese
*Attorney, Agent, or Firm*—Brown, Murray, Flick & Peckham

[57] ABSTRACT

This disclosure relates to a mining machine of the type having a driven winch which has its drive output sprocket engaging a displaced portion of a chain which normally extends along the entire length of the mine face. The displacement portion of the chain occurs between guide rollers on the mining machine. The chain is secured by a plurality of holding devices such as catches clamps or locking devices which are distributed at closely, spaced-apart locations along the length of the chain. As the mining machine propels itself along the chain, the guide roller or an associated member at the forward end of the mining machine releasably retain the chain in the holding devices until the chain is deflected toward the drive output sprocket of the winch. A guide roller or an associated member at the trailing end of the mining machine engage again the returned portion of the chain with the holding device as the chain is passed from the drive output sprocket.

29 Claims, 11 Drawing Figures

CHAIN DRIVE ARRANGEMENT FOR A MINING MACHINE

BACKGROUND OF THE INVENTION

This invention relates to a mining machine for underground mining operations, and more particularly to an improved drive arrangement wherein a chain extends along the mine face and is anchored at spaced-apart locations throughout its length to substantially reduce stretch of the chain which would otherwise occur as the machine propels itself along the chain.

Drum-type cutter-loader mining machines are known in the art for underground mining operation wherein the drum cutter-loader is movable along a face conveyor through the agency of a sprocket wheel which engages a round-link chain extending along the length of the mine face and by which the drum cutter-loader pulls itself therealong. As the mining machine advances along the mine face, the winch sprocket is located in a manner such that it displaces a short length of the chain from its normal extended position. The displaced length of the chain is usually confined between rollers which are disposed before and after the winch sprocket in relation to the length of the machine. The displaced length of chain is therefore generally bounded between these guide rollers. The leading roller retains the chain in its original position and the trailing roller returns the chain links passing from the winch sprocket back to their original or normal position. In relatively long mine faces, the winches must develop a relatively high torque that develops a relatively high tension in the chain which tension can be of the order of 20 Mp during the mine cutting operation. This magnitude of chain tension causes considerable stretching of chain and a stretch of up to 1 meter or more from its normal or free length underground which length is usually within the range of from 150 to 200 meters long. This chain stretch occurs even in instances where a heavy round-link chain is utilized. The chain stretch increases the noise produced by the drum cutter-loader. Moreover, in the event of abruptly changing loads on the chain, the stretch is responsible for severe impacting by the chain. This leads to oscillations of the heavily-loaded part of the chain and, hence, to a constant danger to the machine operator and other personnel in the mine.

SUMMARY OF THE INVENTION

It is an object of the present invention to reduce the stretch of a chain employed to propel an underground mining machine along a mine face by rendering the chain stretch completely independent of the length of the chain which must extend along the entire length of the mine face.

In accordance with the present invention, there is provided a system for securing and guiding a chain-like means which is normally positioned to extend in a longitudinal direction along the path of travel by a mining machine for an underground mining operation, a portion of the chain-like means being continuously displaced from its normal position into an engaging relation with a drive output member of a driven winch on the mining machine to thereby propel the mining machine along the chain-like means, the chain-like means being retained and then returned to its normal position as the mining machine is propelled along by guide members that are spaced apart in relation to the length of the mining machine such that the guide members generally bound between them the displaced portion of the chain-like means for engagement with the drive output member, the improvement comprising holding means engaging the chain-like means at spaced-apart intervals to restrain it along its length, and guide means distinct from the aforesaid guide members and spaced apart in relation to the length of the mining machine at opposite sides of the drive output member to releasably retain the chain-like means by successive ones of the holding means until displacement of the chain-like means towards the drive output member and to engage again the released chain-like means passed from the drive output member with the holding means as the mining machine is propelled along the chain-like means.

More specifically, according to the present invention, the aforementioned holding means include catches or similar devices which are distributed at spaced-apart intervals along the path of the mining machine and subdivide the chain-like means into discrete, relatively short lengths which are devoid of tension except for the portion thereof which is immediately ahead of the mining machine in the direction of its advance and which portion is passing onto the drive output member of the mining machine. In this manner, stretching of the chain-like means occurs only in that portion thereof which is actually experiencing the tension applied to it by the winch. This portion of the chain-like means is located very near the mining machine. This same portion of the chain-like means is so short as to its length that its stretch under the transmitted load becomes vanishingly small and, therefore, it is not disadvantageous. The chain-like means is always disposed in the holding means essentially without tension over substantially its entire length so as not to impair the mining operation while alleviating the disadvantages heretofore associated with chains which extend freely over the entire length of the mine face. To prevent disengagement of the chain-like means from the individual holding means, particularly in regard to instances where the mine floor is undulating or when the mine face conveyor advances toward the mine face, the holding means take the form of catches designed to engage around the chain-like means in which event both of the guide means at the front and the rear of the mining machine function in a manner to open the catch to release and then re-engage the chain-like means therein.

The catches are each conveniently embodied by utilizing two catch halves which are disposed on opposite sides of the chain-like means and retained in a closed position by springs. The catch halves are mounted for movement about a common pivot which is disposed below and extends parallel to the chain-like means. In this way, as the guide means moves toward the two halves forming a closed catch, it engages an opening located slightly above the opening in the halves of the catch which engage the chain-like means. The guide means functions to separate the two halves of the catch, one from the other, as the guide means moves over them to thereby enable disengagement of the chain-like means from that particular catch which has been opened and to re-engage the chain-like means into an opened catch at the rearward end of the machine as it moves along the mine face.

Alternatively, the catch halves which are urged by springs into a closed position at the opposite sides of the chain-like means, are mounted for movement at right angles to the extended length of the chain-like means. The catch halves include slideways which extend into the path of movement by the guide means. A catch constructed in this manner is opened by the guide means which has surfaces that engage the slide surfaces as the mining machine moves along. In this way, the halves of the catch are separated from one another against the spring force and the catch halves remain separated until the chain-like means has been raised out of the catch by the guide element or, alternatively, re-engaged in the catch by the guide element at the rearward end of the mining machine.

A preferred embodiment of the present invention is characterized by providing a rail extending along the length of travel by the mining machine. In this embodiment, the chain-like means takes the form of a round-link chain which rests freely and without biasing on the rail. At the upper surface of the rail and along its entire length, the rail is formed with cogging or toothing members which are spaced apart according to the pitch of the chain and designed to accommodate the shape of each chain link. The length of the portion of the chain which is subject to tension as the mining machine propels itself therealong is maintained at a minimum in this embodiment since only the chain portion which is disposed between the front guide element and the winch output element is tensioned. This is particularly apparent because the cogging or toothing elements follow each other immediately in this region and, therefore, the tension on a portion of the chain is restricted to only that length of the chain which is essentially constant and raised out of contact with the rail. Moreover, this embodiment of the present invention has the desirable feature that no moving parts are required for the holding of the chain along its length. According to another feature of the present invention, the rail as just described can be subdivided into discrete sections corresponding substantially to the length of the pan section of the face conveyor upon which the mining machine moves along. The center distance between the final tooth of a rail section and the first tooth of the immediately adjacent rail section is less than four times the pitch of the chain. Although the chain is retained substantially along its entire length by the rail teeth, chain sag at the rail joint is so small that the chain does not inhibit the advance by the movable elements of the face conveyor. Conveniently, the minimum center distance between the two teeth bounding the gap in the rail sections is limited and equal to four times the chain pitch less the thickness of a chain link.

The rail is secured to the side wall of the face conveyor in a manner to provide for limited lengthwise movement of the rail. The rail is subdivided into discrete sections so that the length of each section is a multiple integral of the chain pitch and at least equal to the length of one conveyor pan section but is less than the pan length plus the pitch of the chain. At least two retaining members, which are connected to the side wall of the face conveyor, each has a projection extending through a recess in a rail section to retain the abutted rail sections in a manner to provide for limited lengthwise movement of the rail section relative to the face conveyor. The height of the recess in the rail is adapted to the projection and the length of the recess in the rail is greater than the length of the projection by an amount of displacement by the rail section relative to the face conveyor. With this form of attachment means for securing the rail to the face conveyor, the chain which engages the toothing on the rail does not inhibit the advance by the movable elements of the face conveyor.

The rail is designed so that its width corresponds to the thickness of the chain and the teeth of the rail can thereby pass into the horizontal links of the chain. The construction of such a rail is relatively simple and inexpensive and the rail can be readily connected to the side wall or spill plate of the face conveyor. The chain links which extend vertically are carried by the rail in the spaces between the teeth only by way of arcuate end regions in each of the teeth. The base in each tooth space is formed with a recess to function in a manner to insure that dust and other foreign matter collecting in the base of the tooth space does not disturb the position of the vertical links of the chain.

Preferably, the aforesaid rail has provisions on both of its sides for supporting the horizontal links of the chain. These provisions take the form of means dimensioned in accordance with the length of the rail sections. The support means in one form are members with round support ledges to thereby not only support the horizontal chain links but also retain the vertical links within the space between adjacent teeth. Alternatively, the members forming the support ledges may take the form of angle-shaped members having vertical arms that enclose the horizontal links in a lateral direction. Moreover, the vertical arms of these members can project upwardly above the horizontal links and form a way or track for skids or rollers of the mining machine. When the mining machine is moved along the length of a mine face on rollers, it is convenient to employ the rollers on the goaf side as guide elements for the chain.

According to another feature of the present invention, the rail may be supported on the floor by a wide foot in a manner to support the weight of the machine at a location spaced from the connection between the rails and the face conveyor. In all forms of the rails hereinbefore described, the recesses in the base of each tooth space should extend downwardly beyond the bottom edge of the two lateral ledges in each tooth so that any dust entering into the tooth space can pass therefrom by way of such a recess.

The present invention further provides deflectable members to retain the chain in the teeth in the rail which members are distributed at spaced intervals along the entire length of the rail and extend into the path of movement by the mining machine or its guide elements. These deflectable members maintain the chain in the teeth of the rail and prevent the chain from lifting off the rail notwithstanding undulations of the floor and advancing movement of the entire face conveyor toward the mine face.

The center distance between the two guide elements on the mining machine which bound the length of chain deflected from its normal position along the path of travel by the mining machine, is equal to or an integral multiple of the pan length of the face conveyor. With this center distance spacing between the guide elements at opposite ends of the mining machine, sag of the chain occurring at the place where the chain bridges the gap in the rails will again occur as the chain is deposited on the rail at the rear of the mining machine at the same gap through the agency of the guide element.

In underground mining operations, steep inclinations of ore seams in the cutting direction bring about an increase in the risk that the upper pull of the chain-like means at the front guide element may actually disengage the mining machine from its support track. To prevent this, the mining machine which moves along the chain-like means is secured against vertical movements in or near the vertical longitudinal plane of the chain-like means. Therefore, in the event of a steep inclination of the ore seam in the cutting direction, the mining machine cannot become disengaged from the face conveyor even when the winch develops a maximum driving torque. The mining machine or parts thereof extend in an opposing relation below lateral supports on the rail so that there is a positive connection constraining the mining machine to move only in a lengthwise direction along the mine face.

According to another feature of the present invention, each of the guide elements on the mining machine takes the form of one rotatable roller that is mounted for rotation about a horizontal shaft extending at right angles to the length of the chain. The surface of the roller includes a peripheral groove which is engaged by vertical portions of the chain links and by the teeth of the rail. The horizontally-disposed chain links tangentially approach the peripheral surface of the guide roller at both sides of the groove.

The present invention further provides means for tensioning or guiding that part of the chain-like means that passes from the sprocket of the winch drive. The tensioning or guide element takes the form of either a roller or a convex slide surface. As the portion of the chain-like means which has been displaced from its original position along the mine face moves tangentially beyond a roller or a slide surface or between two such rollers or two slide surfaces they are moved in a direction to tension the displaced portion of the chain-like means. These rollers or slide surfaces are attached to levers that are biased by springs or a piston and cylinder assembly.

According to another feature of the present invention, instead of utilizing a roller or guide surface, a guide tube is employed through which the displaced portion of the chain-like means passes as it moves toward the sprocket of the drive winch. The end of the guide tube terminates immediately above the teeth of the rail where the guide tube is mounted for vertical movement. The use of the guide tube insures that the chain-like means, that is, for example, a round-link chain, is first brought into a re-engaging relationship with the rail teeth near the rear of the guide element even though the portion of the chain moving from the winch output element is not completely slack but instead has a considerable amount of sag. The length of the guide tube should be substantially equal to one-half the length of the chain extending between the winch output element and rail so that the slack portion of the chain passing from the winch output element can sag before entry into the guide tube.

These features and advantages of the present invention as well as others will be more fully understood when the following description is read in light of the accompanying drawings which illustrate various embodiments of the present invention, and in which.

Figure 1:
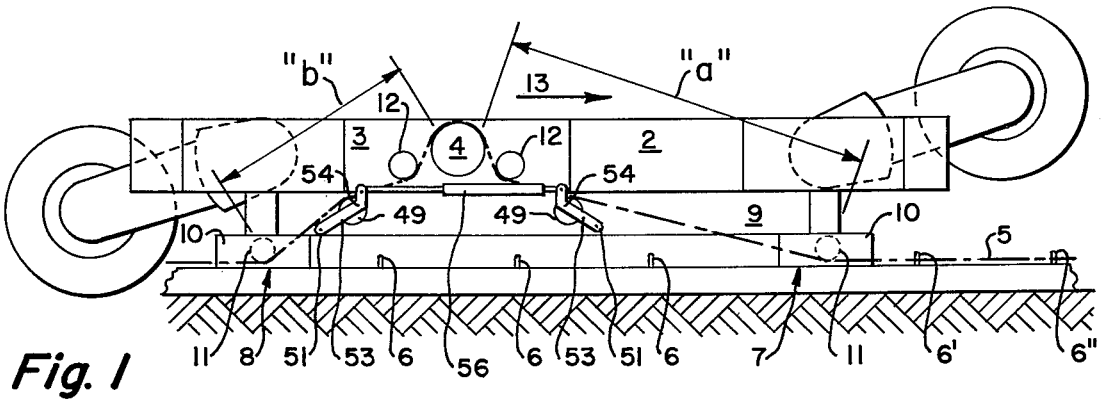
FIG. 1 is an elevational view of a drum-type cutter-loader form of a mining machine and further illustrating in diagrammatic form, catch members or similar devices for holding and guiding a pulling device extending along the path of travel by the mining machine.

The mining machine illustrated in FIG. 1 is in the form of a drum cutter-loader 2 which is movable along a face conveyor 1. The mining machine 2 pulls itself along a round-link chain 5 through the agency of a sprocket wheel 4 which is a drive output member of a winch 3 coupled to a drive motor on the mining machine. The round-link chain 5 extends parallel to the conveyor 1 on the goaf side thereof along essentially the entire length which corresponds to the path traveled by the mining machine. For the purpose of disclosing the features and advantages of the present invention as hereinbefore set forth and as hereinafter more fully described, a round-link chain is the preferred embodiment of a chain-like means. It will be understood, however, by those skilled in the art that other forms of a chain-like means not necessarily the form of a round-link chain may be employed such as a wire rope with cogs or flight attachments at regular intervals along its extended length. Diagrammatically illustrated in FIG. 1 are holding means 6 in the form of catches, clamps, locks or the like which are distributed at regularly-spaced intervals along the entire length of the chain and employed to longitudinally retain the chain at each location of the holding means. The holding means are secured in their normal longitudinal disposition along the chain to the face conveyor 1, to a conventional spill plate for the face conveyor or to a separate support system. The mining machine 2 includes guide members 7 and 8 disposed in the vertical plane of the chain near both ends of the frame 9 of the mining machine. The guide members 7 and 8 delimit the portion of the chain which is deflected as it travels from its original or normal position to and from the sprocket wheel 4. In the embodiment of FIG. 1, the two guide members 7 and 8 are structurally combined with goaf side skids 10 of the frame 9. Each of the guide members takes the form of a roller 11 mounted for rotation about a horizontal shaft arranged inside the skid 10. At both sides of the sprocket 4 there is a guide roller 12 to insure that the chain 5 engages the sprocket wheel 4 in a manner to insure the necessary transmission of a pulling force to propel the mining machine.

As the mining machine moves in the direction indicated by the arrow 13 in FIG. 1, only a portion *a* of the chain 5 which is that length of the chain extending between the sprocket wheel 4 and the catch or other form of holding device 6' located immediately ahead of the guide element 7 is subject to the tension force that is developed to propel the mining machine along the mine face. The chain 5 is, therefore, completely slack over the remainder of its length except for the chain portion *a* since, as illustrated in FIG. 1, only the catch 6' serves as an abutment to resist the pulling force on the chain. As the machine 2 continues to move along the chain and as its front guide element 7 moves beyond the catch 6', the sprocket wheel 4 disengages the chain from the catch 6' and, therefore, catch 6'' retains the chain and resists the pulling force imposed on it to propel the mining machine. In this way, the pull on the chain is transferred and resisted by the consecutively-arranged catches 6. The chain portion *a* always remains relatively short and therefore the stretch of the chain is correspondingly reduced. The portion *b* of the chain is the run off length wherein the chain is disengaged from the sprocket wheel 4 and passes therefrom without tension to the guide element 8 which is the trailing guide element in respect to the just-described direction of movement by the mining machine. At the location of guide element 8, the portion *b* of the chain is first returned back to its original or normal plane and then the chain is engaged with the particular catch 6 over which the guide element just passed. The mining machine can move in either direction along the round-link chain which, for the most of its length, is held in catches 6 in a slacked condition.

Figure 2:
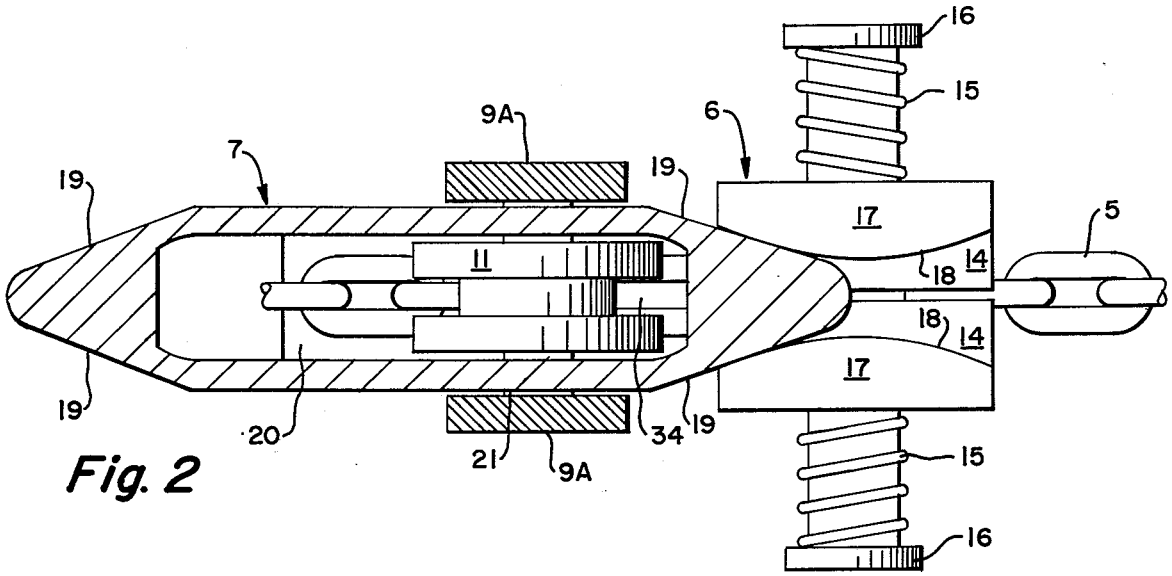
FIG. 2 is a plan view illustrating the detail of the catch or similar device diagrammatically illustrated in FIG. 1.
Figure 3:
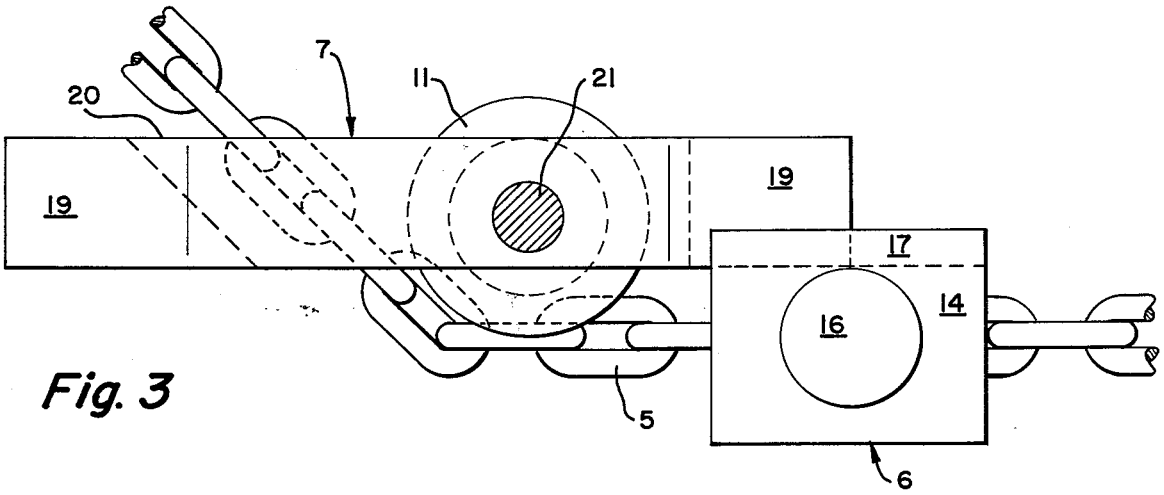
FIG. 3 is a side elevational view of the catch device shown in FIG. 2.
Figure 4:
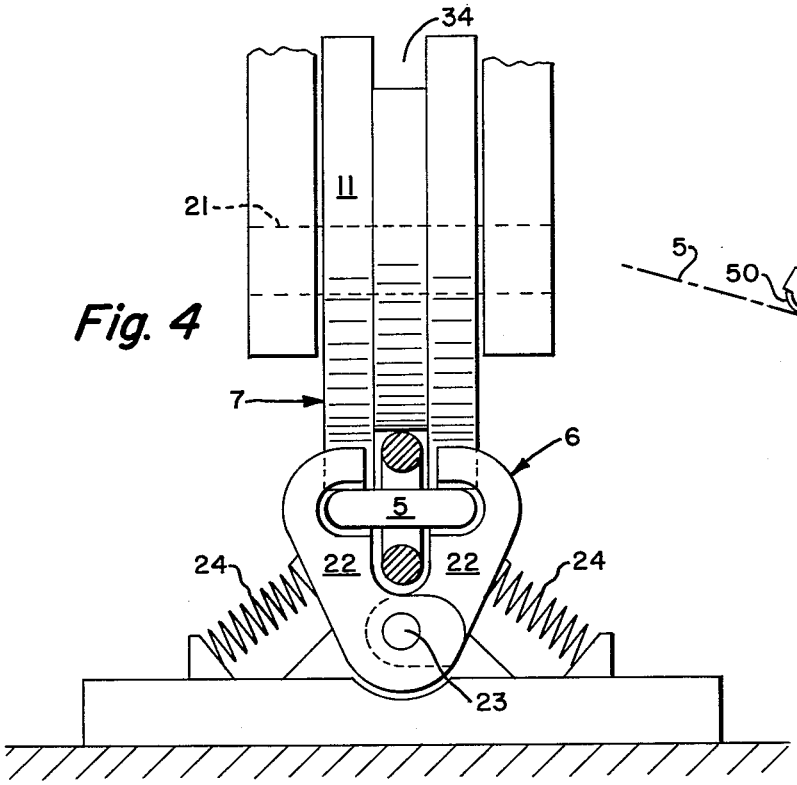
FIG. 4 illustrates a modified form of the catch diagrammatically illustrated in FIG. 1.

FIGS. 2–4 illustrate in greater detail the catches 6 which provide longitudinal retention and surround the round-link chain 5. One embodiment of the catches is shown in FIGS. 2 and 3 while a further embodiment is shown in FIG. 4. In both of these embodiments, the guide elements 7 and 8 retain the chain in its original plane or to restore it to that plane and re-engage it with the catches 6. The guide elements serve the additional functions that the leading surfaces of the elements 7 and 8 open a catch 6 for the removal of the chain 5 and the trailing one of the guide elements in respect to the movement of the mining machine reopens the catch 6 and re-engages the chain therein.

In the embodiment shown in FIGS. 2 and 3, two catch halves 14 form one catch 6. The catch halves are mounted for movement in opposition to a biasing force developed by springs 15 and held by an enlarged head on a pin 16 which is connected, for example, to the spill plate not shown, and extends transversely to the length of the chain. The biasing forces developed by the springs 15 urge the catch halves 14 into positive engagement with the chain 5. The two catch halves together form a surrounding relation with the chain and retain it against longitudinal movement. Projections 17 extend from the top of the catch halves 14 into the path of travel by the guide elements 7 and 8. The projections 17 for a catch define oppositely-disposed and arcuate ways 18 that abut with and engage tapering surfaces 19 of the guide element 7 or 8 which in this embodiment forms a skid. Each guide element 7 and 8 is formed with an aperture 20 and extending therein is a shaft 21 supporting a roller 11 which, in turn, guides the chain 5. The guide elements 7 and 8 are secured to the machine frame 9 by brackets 9A or the like. As is clearly apparent from FIGS. 2 and 3, the chain 5 passes through the aperture 20 in the front guide as defined by the movement of the mining machine. The chain moves toward the winch sprocket wheel 4 while in the case of the guide element at the rear of the mining machine, the chain passes through the aperture 20 of that guide element to assume its original or normal position where it is passed into an opened catch 6 by the passage of the tapering surface 19 of the guide element. The catch is then automatically reclosed by the springs 15.

FIG. 4 illustrates a further embodiment of the catch 6 wherein two catch halves 22 are joined together by a pin 23 extending along the plane of the chain 5. A base plate has brackets that support one end of springs 24 which engage at their other ends the halves 22 of the catch. In the embodiment according to FIG. 5, each of the guide elements 7 and 8 takes the form of a roller 11 which extends below the top edge of the catch halves 22 so that as the mining machine moves along, the roller abuts against the top edges of the halves 22 and separates them from one another against the force developed by the springs 24 to such an extent that the chain 5 is disengaged from the catch 6.

Figure 7:
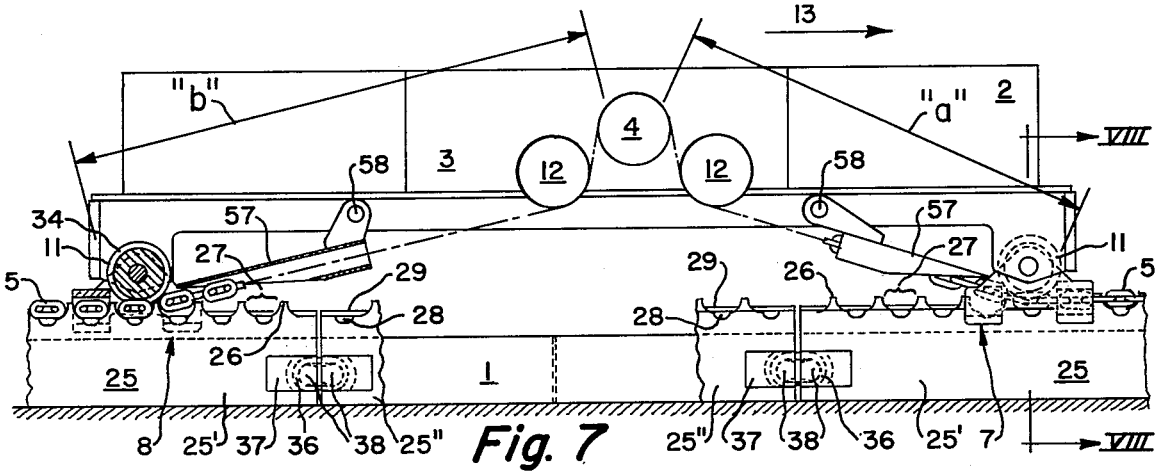
FIG. 7 is an elevational view of a mining machine wherein a modified form of the present invention includes a round-link chain and a rail with support teeth.
Figure 8:
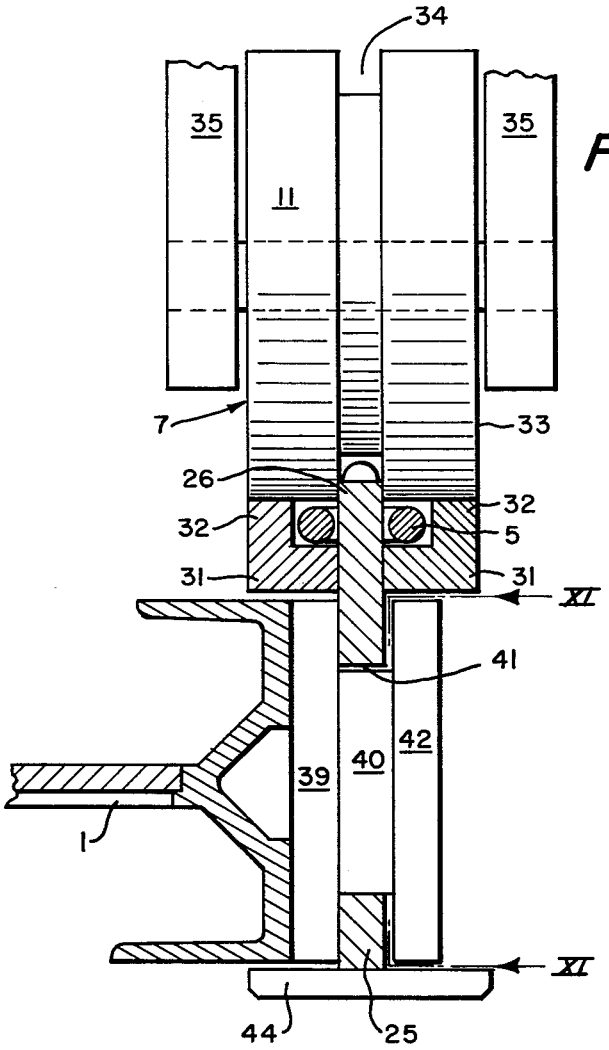
FIG. 8 is a sectional view taken along line VIII—VIII of FIG. 7 and illustrating the cross-sectional shape of a rail according to a further embodiment of the present invention.
Figure 9:
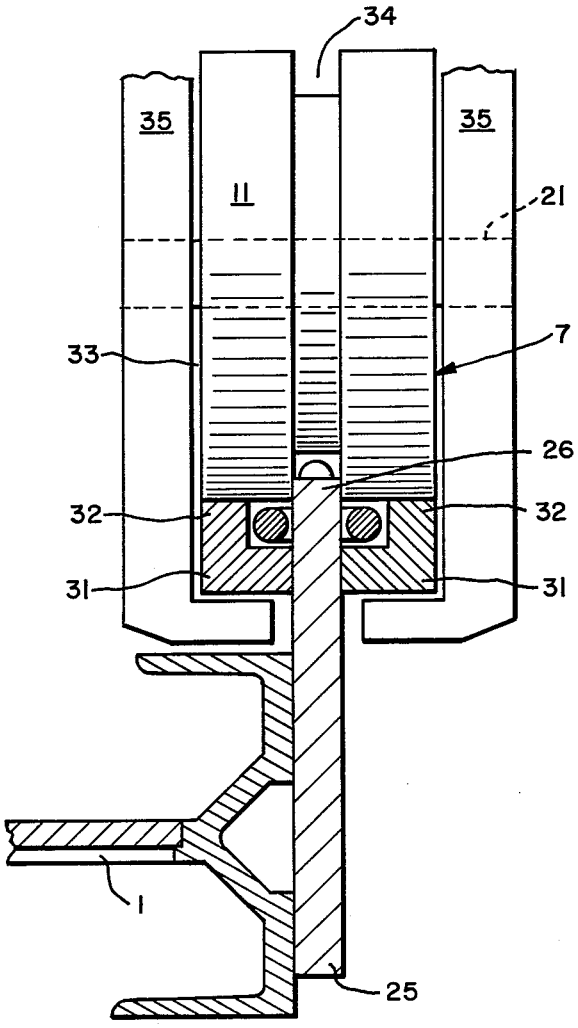
FIG. 9 is a sectional view similar to FIG. 8 and illustrating a further embodiment of the rail.
Figure 10:
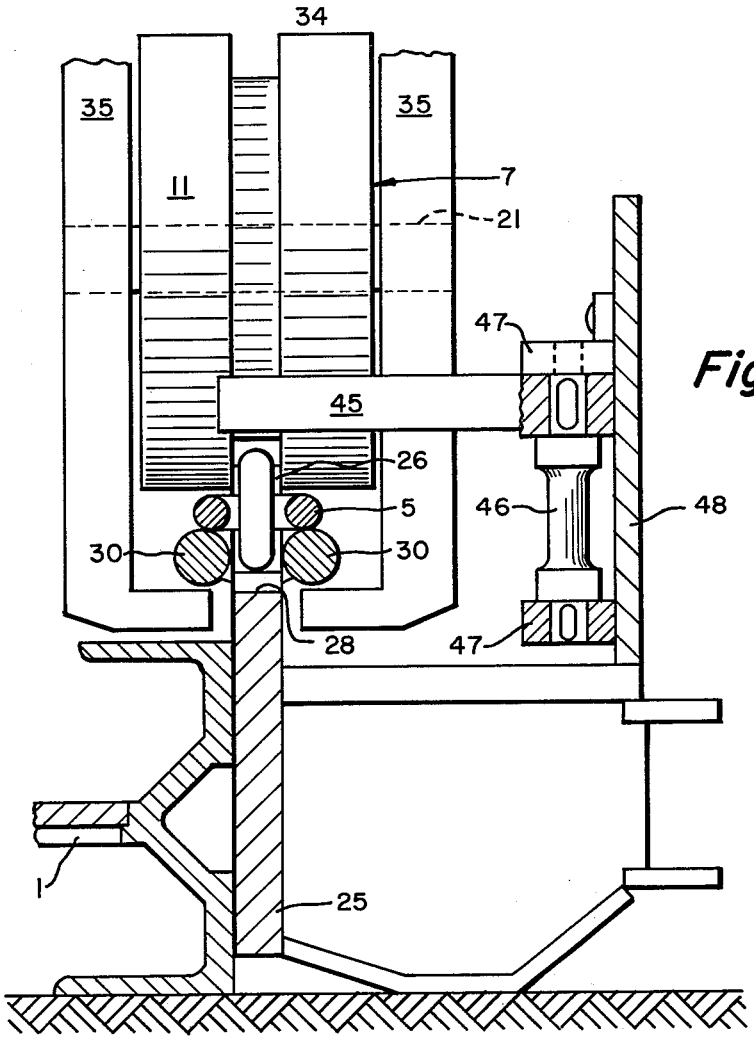
FIG. 10 is a cross-sectional view similar to FIG. 8 and illustrating a still further embodiment of the present invention.

FIG. 7 illustrates another embodiment of the present invention wherein the chain 5 rests on a rail 25 which is secured to the side wall, or alternatively, to the spill plate of a face conveyor. The top surface of the rail 25 has cogs or teeth 26 that are engaged by the horizontally-disposed links of the chain. The width or thickness of the rail is less than the internal space in the links which are horizontally disposed. In the spaces between the teeth, a recess 28 is formed at the longitudinal center thereof such that a vertically-arranged link is supported only at the end zones in the tooth space 27. This relationship of parts is clearly illustrated in FIG. 11 and provides improved results according to the present invention. The rail 25 includes means 29 for the lateral support of the horizontally-disposed links. As can be seen in FIG. 10, the means 29 take the form of two continuous round bars 30 extending along each side of the rail and define ledges that form lateral support for the vertically-arranged links in the tooth spaces 27. In FIGS. 8 and 9, alternative forms of support means 29 are illustrated and take the form of short members which extend along most of the regions of the individual teeth 26 or they take the form of angle-shaped members 31 whose length corresponds to the length of the conveyor pan. The angle-shaped members 31 extend laterally from each side of the rail outwardly beyond the horizontally-disposed links so that their vertical arms 32 extend upwardly above the horizontally-disposed links. The angle-shaped members 31, therefore, form a way or track to engage the skids 10 as shown in FIG. 1 or, alternatively, the rollers 33 of the mining machine. The skids 10 or the rollers 33 serve the additional function of guiding the chain 5 and thus replace the function of the guide members 7 and 8 previously described and enable the engagement by the mining machine on the track formed by the arms 32. Any dust or other foreign material entering into the tooth spaces 27 passes therefrom through the recesses 28 which, as previously described, are formed in the base of the tooth spaces 27 such that they lie below the support means 29, 30 or 31.

The cylindrical face of rollers 11 or 33 shown in FIGS. 1–5 and 7–10 has a groove 34 that receives the vertically-arranged links of the chain 5 and the teeth 26 of the rail. The horizontally-disposed links of the chain make a tangential approach with the peripheral face portions of the rollers 11 or 33 which face portions are disposed at both sides of the groove 34.

As shown in FIGS. 9 and 10, L-shaped arms 35 extend from the frame 9 at the goaf side of the mining machine. These arms may form part of the frame 9 or, alternatively, these arms can be made as an integral part of the mounting for the rollers 33. The L-shaped arms 35 pass below and extend beneath the ledge support members 29–31 to prevent the mining machine 2 from lifting or otherwise becoming disengaged from the track on the goaf side in the event of a dip in the mine seam in the cutting direction.

With reference to FIG. 7, the rail 25 is subdivided into discrete rail sections 25' and 25'' in the manner such that the length of a rail section corresponds to the length of a pan section forming the face conveyor 1. The use of rail sections will not impair the advancing movement by the face conveyor toward the mine face. At the transition or gap between the rail sections, the distance between the last tooth 26 of one rail section and the first tooth 26 of the next rail section is such that the center distance between these teeth is less than four times the chain pitch. In FIG. 7, the distance between two such teeth is shown to be less than four times the chain pitch by an amount corresponding to the thickness of a chain link. In this way, there is always a slight sag to the chain at the transition or gap between two rail sections. This insures that there is sufficient freedom for movement between the rail sections and the pan sections of the conveyor without detriment to the chain 5. The rail sections are interconnected at their gaps by fish plates 36. Connecting members 37 are welded within recesses formed in the ends of the two abutting rails. These connecting members each has a projection 38 extending toward the side wall of the conveyor whereby the fish plate 36 binds together the projections and thereby interconnects the rails. An abutment between the members 38 of two rail sections is selected so as to determine the minimum center distance between the terminal and teeth on the rails. The fish plate 36 determines the maximum center distance between these teeth in the presence of a force tending to pull the sections of the conveyor apart from one another.

Figure 11:
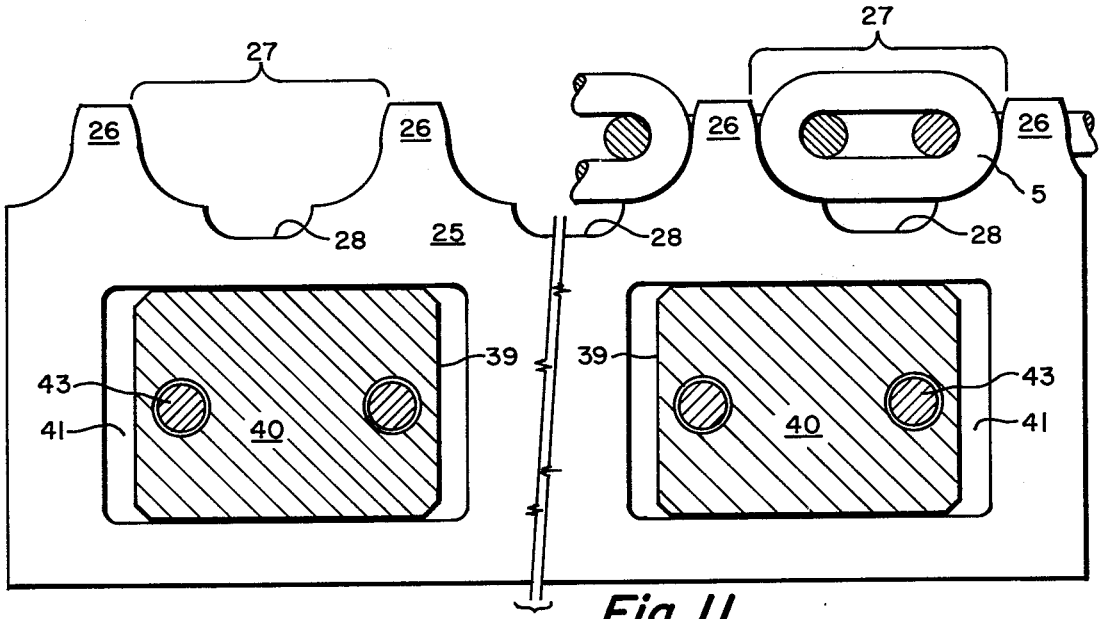
FIG. 11 is an elevational view taken along line XI—XI of FIG. 8.

According to the embodiment of the present invention illustrated in FIGS. 8 and 11, the rails 25 are secured to the side wall of the face conveyor in a manner for providing limited provision for longitudinal movement. In this embodiment, the rails 25 are subdivided into discrete abutting portions, the length of a single portion being an integral multiple of the pitch of a chain link and being at least equal to the length of one conveyor pan but always less than the length of the pan plus the pitch of the chain 5. In the embodiment shown in FIGS. 8 and 11, each rail section is retained by at least two retaining members 39 which are secured to the side wall of the conveyor. Each of the members 39 engages a projection 40 extending through a recess 41 in the rail sections. The recess 41 is constructed in the rail section for sufficient or desired longitudinal movement of the rail section relative to the pan section of the conveyor. Plates 42, retained by bolts 43, secure the rail sections to the projections 40. Since the gap between the rails substantially coincides with the gaps or junctions in the conveyor pan, the unjoined rail portions will not impair the advancing movement carried out by the face conveyor 1. As shown in FIG. 8, the rail 25 is supported on the floor by a wide foot 44. In this way, the weight of the mining machine 2 is supported at a location spaced from the members 39, particularly when the support member 31 is provided for use as a track or guidway for the mining machine.

In the embodiment shown in FIG. 10, deflectable arms 45 are distributed along the length of the rail to retain the chain 5 in the teeth 26 on the rail. The deflectable arms 45 insure that the chain does not become disengaged from the teeth 26 even though there are substantial undulations to the floor and when the face conveyor 1 advances along the floor. Since the deflectable arms 45 extend into the path of movement by the mining machine including the guide elements 7 and 8, the deflectable members are moved out of the vertical plane of the chain just prior to the time when the chain is disengaged from the teeth 26. This movement of the deflectable arms 45 is repeated at the rear guide 7 or 8, depending upon the direction of movement by the mining machine, so that the chain 5 can be re-engaged within the teeth 26. A spill plate 48 for the conveyor carries spaced-apart brackets 47 that support between them a torsion bar 46. The torsion bar is keyed or otherwise retained in a non-rotatable manner by the lower bracket 47 while the upper bracket 47 rotatably supports the torsion bar. An arm 45 is rigidly attached to the torsion bar so that in its normal position it extends into the longitudinal plane of the chain, while in the deflected position, it assumes substantially a right angled position to the length of the chain.

Figure 6:
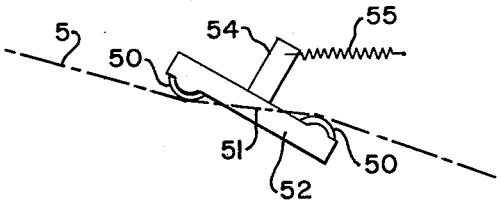
FIG. 6 is a detailed view of an alternate form of chain tensioning device to that illustrated in FIG. 5.
Figure 5:
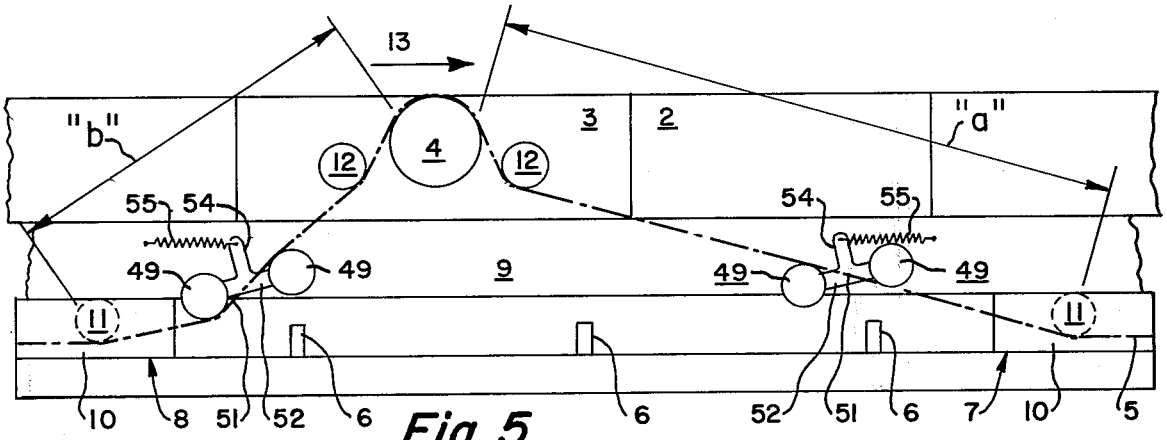
FIG. 5 is a partial elevational view of a mining machine which includes a device for tensioning the chain.

With reference now to FIGS. 1, 5 and 6, the mining machine frame 9 supports a tensioning element having rollers 49 or convex slideways 50 which contact the lengths *a* and *b* of the chain. The rollers 49 or slideways 50 are carried by pairs of levers 52 or 53 and, if preferred, individually by levers 52 and 53 may be provided. These levers are pivotally mounted on a shaft 51 to the frame 9. A tension spring 55 is connected to an arm 54 projecting from each lever and transmits a tensioning force via the rollers 49 or slideways 50 to the chain portion *a* or *b* which moves between them. The springs 55 can be replaced by piston and cylinder assemblies 56 as shown in FIG. 1 to produce the desired tensioning of the portions *a* and *b* of the chain. In this instance, the rollers 49 are disposed at the underside of the portions *a* and *b* of the chain and levers 53 carry the rollers as they are urged in an upward direction by a common piston and cylinder assembly 56.

The rollers 49 or convex slideways 50 can be replaced as shown in FIG. 7 by guide tubes 57 which are pivotally mounted by shafts 58 to the frame 9. The length of the respective ones of the guide tubes 57 is approximately one-half the length of the chain portion *a* or *b*. The guide tubes are mounted on shafts 58 for pivotal movement in a vertical direction. The guide tubes surround the chain 5 to prevent sag of the chain near the rail 25 whereby any slack in the chain is transferred to the gap between the guide rollers 12 and guide tubes 57.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In an apparatus for securing and guiding a chain-like means which is normally positioned to extend in a longitudinal direction along the path of travel by a mining machine for underground mining operations, a portion of the chain-like means being continuously displaced from its normal position into an engaging relation with a drive output member of a driven winch on the mining machine to thereby propel the mining machine along the chain-like means, guide members spaced apart in relation to the length of the mining machine to retain and then return the chain-like means to the normal position as the mining machine is propelled along such that the guide members generally bound between them the displaced portion of the chain-like means for engagement with the drive output member, the improvement comprising:

holding means engaging said chain-like means at spaced-apart intervals to restrain the chain-like means along the length thereof, each holding means resisting the tension load imposed upon the length of chain-like means lying ahead of the mining machine in relation to the propelled movement thereof by the driven winch on the mining machine; and guide means distinct from said guide members and spaced apart in relation to the length of said mining machine at opposite sides of said drive output member to releasably retain said chain-like means by successive ones of said holding means until displacement of the chain-like means toward the drive output member and to engage again the released chain-like means passed from the drive output member with the holding means as the mining machine is propelled along said chain-like means.

2. The apparatus according to claim 1 wherein each of the said holding means includes a catch member constructed in a manner to form a surrounding relation with said chain-like means for the retention thereof, and wherein said guide means are carried at the front and rear of said mining machine to open a catch member for disengagement and re-engagement with said chain-like means.

3. The apparatus according to claim 1 wherein each of said holding means includes:

two catch halves disposed on opposite sides of said chain-like means;

means arranged below and extending parallel to said chain-like means for pivotally interconnecting said two catch halves, and resilient means for urging said catch halves toward each other.

4. The apparatus according to claim 3 wherein said guide means project from said mining machine in relation to the closed position of said catch halves at least to the surfaces thereof which engage said chain-like means for separating the catch halves one from the other as the guide means moves therealong.

5. The apparatus according to claim 1 wherein each of said holding means includes:

two catch halves disposed on opposite sides of said chain-like means, said catch halves having slideways extending within the path of movement by said guide means;

means to mount said catch halves for movement in a direction which is normal to the longitudinally-extending direction of the chain-like means; and resilient means for urging said catch halves toward one another.

6. An apparatus according to claim 1 wherein said guide means each include two guide surfaces and wherein each of said holding means include two catch halves and spring means for urging the catch halves in a direction to maintain them in a restraining relation with said chain-like means, said catch halves having slideways adapted for engagement by said guide surfaces for separating the catch halves until said chain-like means is raised out of the catch halves toward said guide member at the front of the mining machine and at the rear of the machine, said guide surfaces engaging the slideways of the catch halves until the chain-like means is displaced into the catch halves from the guide member.

7. The apparatus according to claim 1 wherein said holding means includes a rail extending in a direction along the length of said chain-like means, said chain-like means being further defined to include a round-link chain for resisting the force developed to propel the mining machine, said rail including teeth at spaced intervals corresponding to the pitch of said round-link chain for carrying and restraining the chain.

8. The apparatus according to claim 7 further comprising a face conveyor extending along the path of travel by the mining machine, said rail being subdivided into discrete sections whereby the length of a rail section substantially corresponds to the length of a conveyor section forming part of said face conveyor, said teeth on said rail sections being arranged such that the center distance between the teeth of abutting rail sections is less than four times the pitch of said round-link chain.

9. The apparatus according to claim 8 wherein the minimum center distance between the teeth of abutting rail sections is equal to four times the pitch of said round-link chain less the chain link thickness.

10. The apparatus according to claim 7 further comprising a face conveyor including a plurality of conveyor pan sections, said rail being subdivided into rail sections each having a length which is an integral multiple of the pitch of the round-link chain such that the length of a rail section is less than the length of a conveyor pan section plus the pitch of the round-link chain, and means for securing a rail section to a conveyor pan section for limited lengthwise relative movement.

11. The apparatus according to claim 10 wherein said means for securing are further defined to include at least two retaining members attached to a side wall of said face conveyor, each of said retaining members including a projection extending through a recess in said rail, the length of the projections being less than the length of the recesses in the rail by an amount corresponding to a desired displacement of the rail relative to the face conveyor.

12. The apparatus according to claim 7 wherein the width of said rail including the teeth thereof corresponds to the thickness of said round-link chain for passage of rail teeth into horizontally-disposed links.

13. The apparatus according to claim 12 wherein the space between teeth of said rail is formed with arcuate end regions to support vertically-arranged links of said chain, and wherein a recess extends below the chain link support surface for the vertically-arranged links.

14. The apparatus according to claim 7 further comprising means at each side of said rail for supporting horizontally-disposed links of said chain.

15. The apparatus according to claim 14 wherein said means at each side of the rail include a round bar extending in the direction along the length of said rail.

16. The apparatus according to claim 15 wherein said means at each side of said rail include an angle-shaped member arranged in a manner that a vertically-extending arm thereof encloses a lateral side of a horizontally-disposed link of said chain.

17. The apparatus according to claim 16 wherein the vertically-extending arm of each angle-shaped member extends upwardly above the horizontally-displaced links of said chain in a manner that the upper surface of the arm defines a support surface for said mining machine.

18. The apparatus according to claim 17 wherein said guide members and said guide means are carried by said support surface of the angle-shaped members.

19. The apparatus according to claim 18 further comprising wide foot members for supporting said rail upon the floor of the mine.

20. The apparatus according to claim 16 wherein the space between the teeth of said rail include support surfaces for vertically-disposed links of said chain and wherein a recess extends below said support surfaces and beyond the bottom edge surfaces of said angle-shaped member.

21. The apparatus according to claim 16 further comprising retaining arms carried by said mining machine to extend below and in an opposing relation with the bottom face surface of said angle-shaped member.

22. The apparatus according to claim 7 further comprising deflectable members extending in the path of travel by said mining machine at spaced intervals along said rail for retaining said chain in an engaging relation with the teeth on the rail.

23. The apparatus according to claim 7 further comprising a face conveyor defined by a plurality of pan sections arranged to extend along the path of travel by the mining machine, the distance between the spaced-apart guide members which bound between them the displaced portion of the chain, being an integral multiple of the pan section of said face conveyor.

24. The apparatus according to claim 7 wherein said guide means are rollers each rotatably mounted on a horizontal shaft supported by said mining machine to extend in a direction normal to the extended direction of said chain, each of said rollers having a groove-like recess extending from the outer surface for engaging the vertically-disposed links of said chain whereby the horizontally-disposed links of the chain tangentally approach the peripheral surface of said roller.

25. The apparatus according to claim 7 further comprising guide tubes receiving said chain at each of said guide means at spaced locations just above the teeth of said rail, and support means carrying said guide tubes for vertical movement.

26. The apparatus according to claim 25 wherein said guide tubes each has a length substantially equal to one-half of the length of said chain extending between said drive output member and respective ones of said guide means.

27. The apparatus according to claim 1 further comprising retaining means for holding said mining machine against vertical displacement substantially along the vertical longitudinal plane of said chain-like means.

28. The apparatus according to claim 1 further comprising means carried by said mining machine for tensioning said chain-like means along the displaced portion thereof lying between said guide members.

29. The apparatus according to claim 1 further comprising tensioning means for engaging the lengths of said chain-like means extending between said drive output members and each of said guide means, levers carried by said mining machine for supporting said tensioning means, and means engaging said levers to transmit tensioning forces to said tensioning means.

* * * * *